US005496162A

United States Patent [19]

Schnell

[11] Patent Number: 5,496,162

[45] Date of Patent: Mar. 5, 1996

[54] AIR-COOLED VANE-CELL COMPRESSOR

[75] Inventor: Manfred Schnell, Schopfheim, Germany

[73] Assignee: Mannesmann Aktiengesellschaft, Düsseldorf, Germany

[21] Appl. No.: 349,266

[22] Filed: Dec. 5, 1994

[30] Foreign Application Priority Data

Dec. 3, 1993 [DE] Germany ..... 43 41 716.7

[51] Int. Cl.[6] ..... F01C 21/06

[52] U.S. Cl. ..... 418/101

[58] Field of Search ..... 418/101, 259, 418/260, 265, 266

[56] References Cited

U.S. PATENT DOCUMENTS

| | | | |
|---|---|---|---|
| 2,876,948 | 3/1959 | Hockel et al. | 418/101 |
| 3,016,184 | 1/1962 | Hart | 418/101 |

FOREIGN PATENT DOCUMENTS

| | | | |
|---|---|---|---|
| 893247 | 12/1953 | Germany | 418/101 |
| 647052 | 10/1962 | Italy | 418/101 |

*Primary Examiner*—Charles Freay

*Attorney, Agent, or Firm*—Cohen, Pontani, Lieberman, Pavane

[57] ABSTRACT

An air-cooled vane-cell compressor is provided which has a housing, a bore hole therethrough and an outer surface. Cooling air fins are arranged on the housing surface in a longitudinal direction of the housing. A rotor which has two free shaft ends is arranged within the housing eccentric to the housing bore. Covers are arranged on front faces of the housing and the rotor shaft ends are rotatably supported in the covers. A suction flange and an ejection flange are arranged in the housing at 90° to the covers and along a common longitudinal axis. The rotor has a rotational axis that is symmetrically arranged to the outer contour of the housing and to the flanges, and the housing bore is doubly eccentric to the rotational axis of the rotor in a top dead center direction.

6 Claims, 3 Drawing Sheets

AIR-COOLED VANE-CELL COMPRESSOR

BACKGROUND OF THE INVENTION

1. Field of the Invention

The invention relates to an air-cooled vane-cell compressor.

2. Description of the Prior Art

Air-cooled vane-cell compressors are known in principle and are used for various purposes, for example, for silo and tank vehicles. These air-cooled compressors have a housing which is equipped with feet and with cooling ribs lying in the longitudinal direction of the housing. In this housing, eccentric to the housing bore, there is a rotor, which is equipped with radially movable blades and the shaft journals of which are supported in beatings from covers which are located on the front faces of the housing. Flanges are arranged on the housing at 90° to the covers for suctioning in or expelling the medium and the longitudinal axes of the flanges are aligned with one another. The rotor has two free shaft ends, on each of which a ventilator is located for the purpose of air-cooling.

This design, which has been in use for years, has the disadvantage that the temperature distribution varies greatly circumferentially and that relatively large sealing gaps are required due to the distortion of the housing. However, large sealing gaps mean relatively poor efficiency, since the size of the sealing gap has a significant influence on efficiency, due to power loss.

SUMMARY OF THE INVENTION

Accordingly, it is an object of the present invention to provide an air-cooled generic air-cooled vane-cell compressor that can be operated with narrower sealing gaps than previously possible and is thus more efficient.

Pursuant to this object, and others which will become apparent hereafter, an aspect of the present invention resides in an air-cooled vane-cell compressor having a rotor with a central axis that is symmetric to the outer contour of the compressor housing and the flanges of the suction and pressure sides. Additionally, the bore of the housing is doubly eccentric relative to the central axis in tile direction of top dead center.

In contrast to the known prior art, the vane-cell compressor according to the invention has a ribbing which varies around tile cylindrical surface of the housing. The non-uniform ribbing relates to tile fact that higher cooling ribs are located in the area of the bottom dead center and the pressure flange, so that larger cooling air cross-sections result. Higher ribs mean more surface area and thus better heat dissipation in the critical area of the compressor. These measures serve to even out tile temperature distribution in the circumferential direction, so that narrower sealing gaps can be used, due to the reduced thermal distortion. Narrower sealing gaps mean better efficiency compared to the known compressors.

The arrangement of higher ribs in the aforementioned critical area is made possible by the fact that the rotor axis coincides with the center point axis of the housing and that the housing bore is arranged doubly eccentric thereto, whereby the double eccentricity lies in the direction of the top dead center.

As a further measure, the feet and the flanges are arranged symmetrical to the rotor axis in the known manner, so that universal installation in vehicles is possible. Regardless of which longitudinal side of the compressor is used as the stopping face, the centrality of the rotor shaft, and thus the agreement with the axis of the drive machine, is maintained.

The effect of the varied ribbing can be amplified even more if the ribs have an inclination in their end areas relative to the longitudinal axis of the housing, whereby the inclination is slanted toward the suctioning side. As a result of this inclination, a greater share of the cooling air volume is pressed in the direction of the pressure flange, and the cooling air is thus conducted more deliberately to the hot zones. This measure serves to further optimize cooling and to improve the evening out of the temperature.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
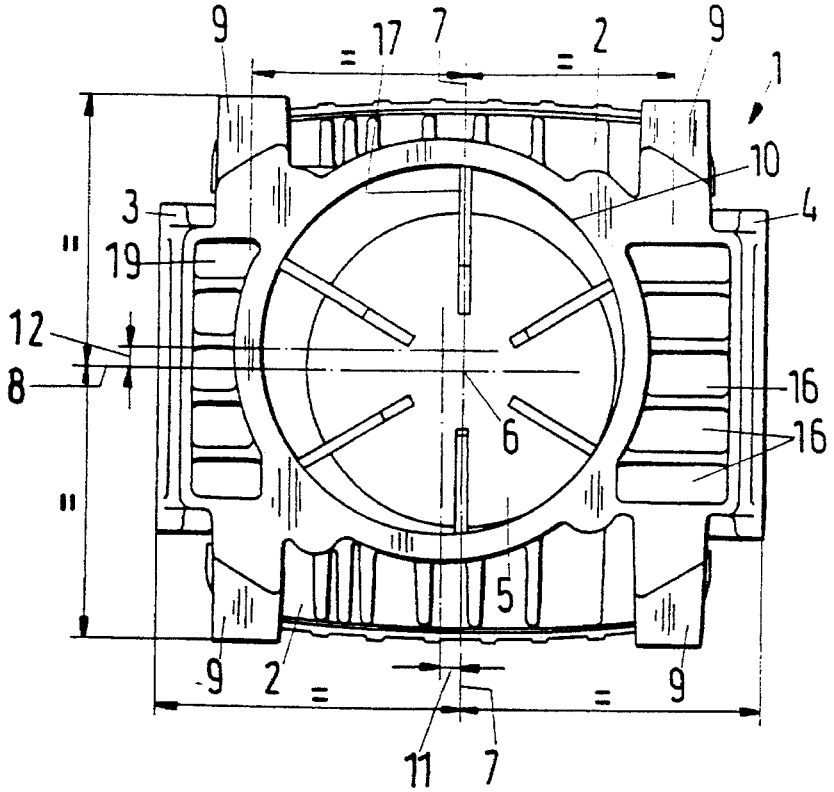
FIG. 1 is a view with a partial breakout in Direction X of FIG. 3 of an air-cooled vane-cell compressor according to the invention.
Figure 2:
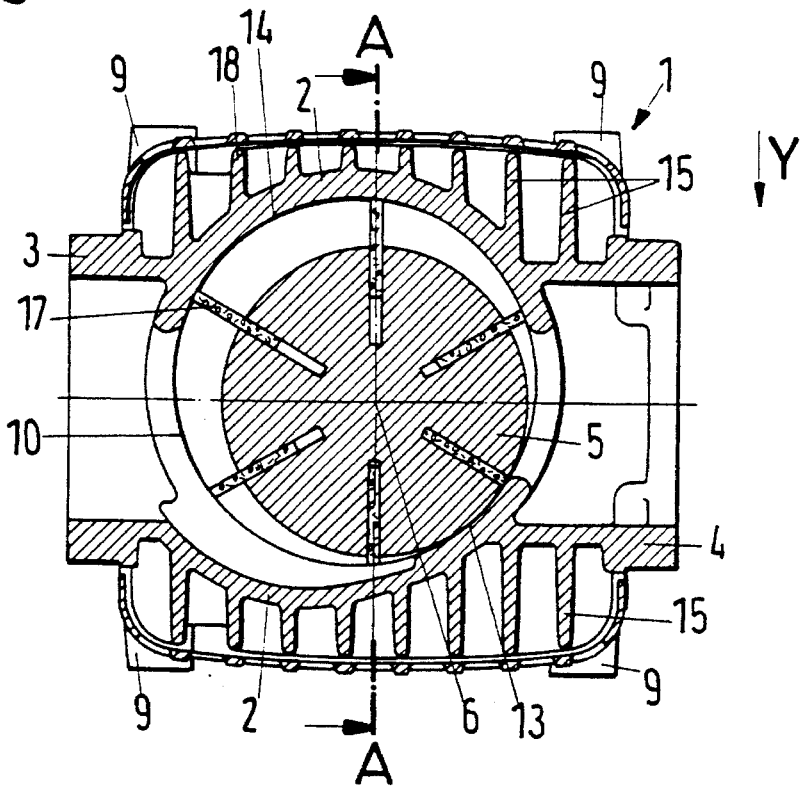
FIG. 2 is a cross-section along Line B—B of FIG. 3.
Figure 3:
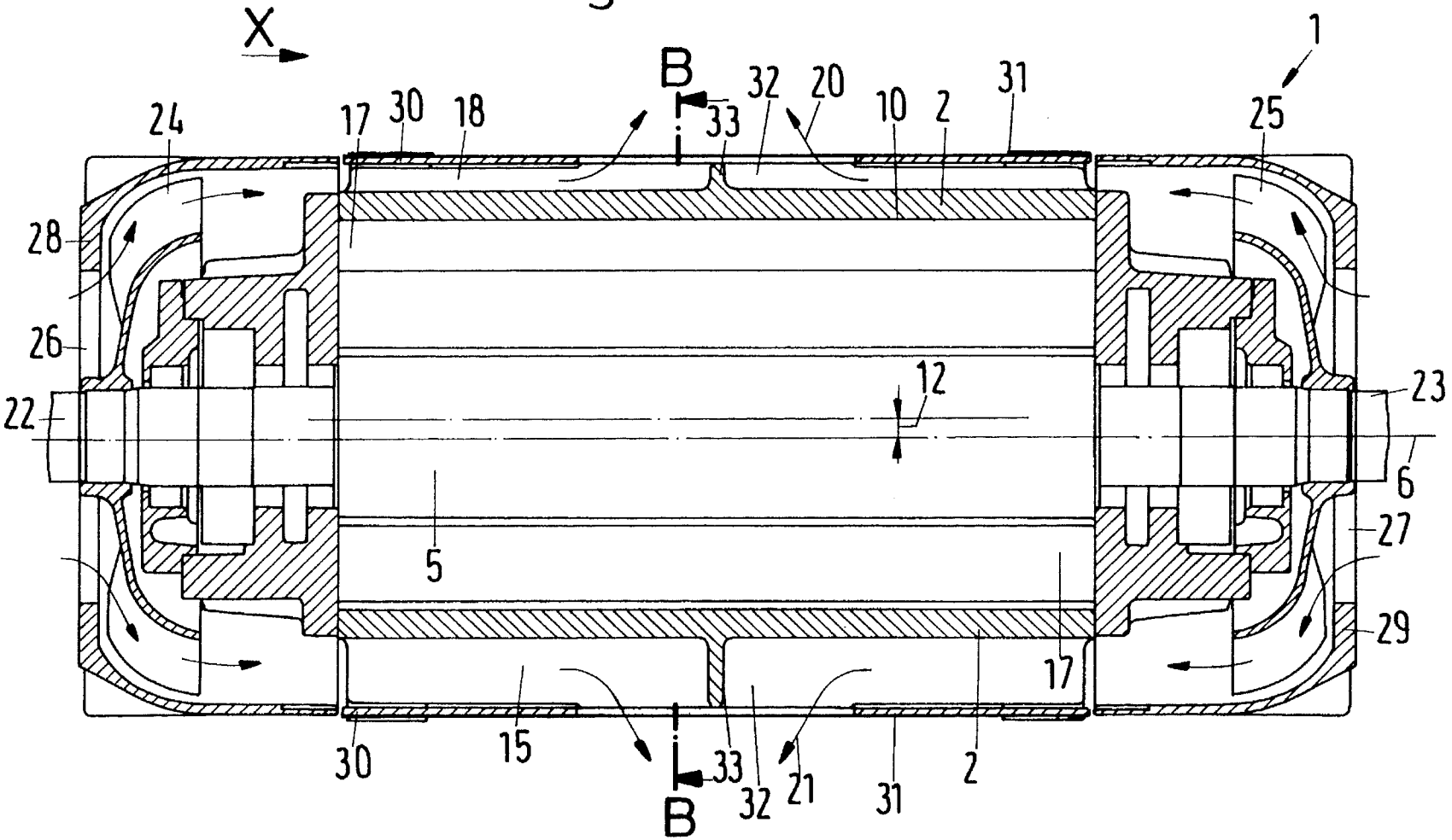
FIG. 3 is a longitudinal section along Line A—A of FIG. 2.

FIGS. 1 to 3 show an air-cooled vane-cell compressor 1 according to the invention in a view with a partial breakout, a cross-section and a longitudinal section, respectively. The compressor consists of a one-piece housing 2, which has tinning in the upper and lower mantle area. Also integrated in the housing 2 are flanges 3, 4 for the suctioning and pressure sides, respectively. In FIGS. 1 and 2, the symmetrical arrangement according to the invention of a rotor 5 relative to a central longitudinal axis 6 of the housing 2 can be seen. In order to illustrate centrality, in FIG. 1 the distances from a central axis 7 to the front faces of flanges 3, 4 and to the axes of the feet 9 as well as the distances from a central axis 8, perpendicular to the axis 7, to the front faces of the feet 9 have been provided with an equal sign. In contrast to the central positioning of the housing bore with respect to the central longitudinal axis 6 of the housing 2 which was customary in the prior art, the housing bore 10 according to the present invention is arranged eccentric to the axis 6. In this example, the housing bore 10 is in fact displaced in a doubly eccentric fashion. To illustrate this, both the displacement 11 from the axis 7 and the displacement 12 from the axis 8 are indicated. This also means that the bottom dead center 13 and the top dead center 14 do not lie with equal axes, as is usual, but are rather at approximately a right-handed angle of 45° in respect to the axis 7. The displaced arrangement of the housing bore 10 has the advantage that higher fins 15, 16 may be located in the area of the bottom dead center 13 and the pressure flange 4 than those 18, 19 in the area of the suction flange 3. Because the greatest quantity of heat accumulates in this area, due to the adiabatic compression of the medium and the friction of the rotor blade 17, particularly intensive cooling is desirable here in order to even out the temperature distribution as much as possible in the circumferential direction.

FIG. 3 once again shows the described relationships in longitudinal section. Here, too, the offset 12 of the housing bore 10 in respect to the axis 8 is recognizable. For the upper suctioning area, this results in fins 18 with less height than the fins 15 located lower in the pressure area, which have greater heights. The cooling cross-sections also vary to the same extent, as illustrated here by the arrows 20, 21.

In the known manner, the compressor 1 has two free shaft ends 22, 23, on which fan propellers 24, 25 are attached, respectively. So that air is forced via a certain route, there is hood 28, 29 on each front face of the housing 2. The hoods 28, 29 can be made of light metal, and have a front side opening 26, 27. The tinning is also circumferentially covered 30, 31 across a certain length. The cooling air sucked in via the fan propellers 24, 25 can escape via the open gaps 32 in the central area. So that the longitudinal distortion of the housing 2 lies symmetrical to the center, a cross-fin 33 is located in the area of the open fins.

Figure 4:
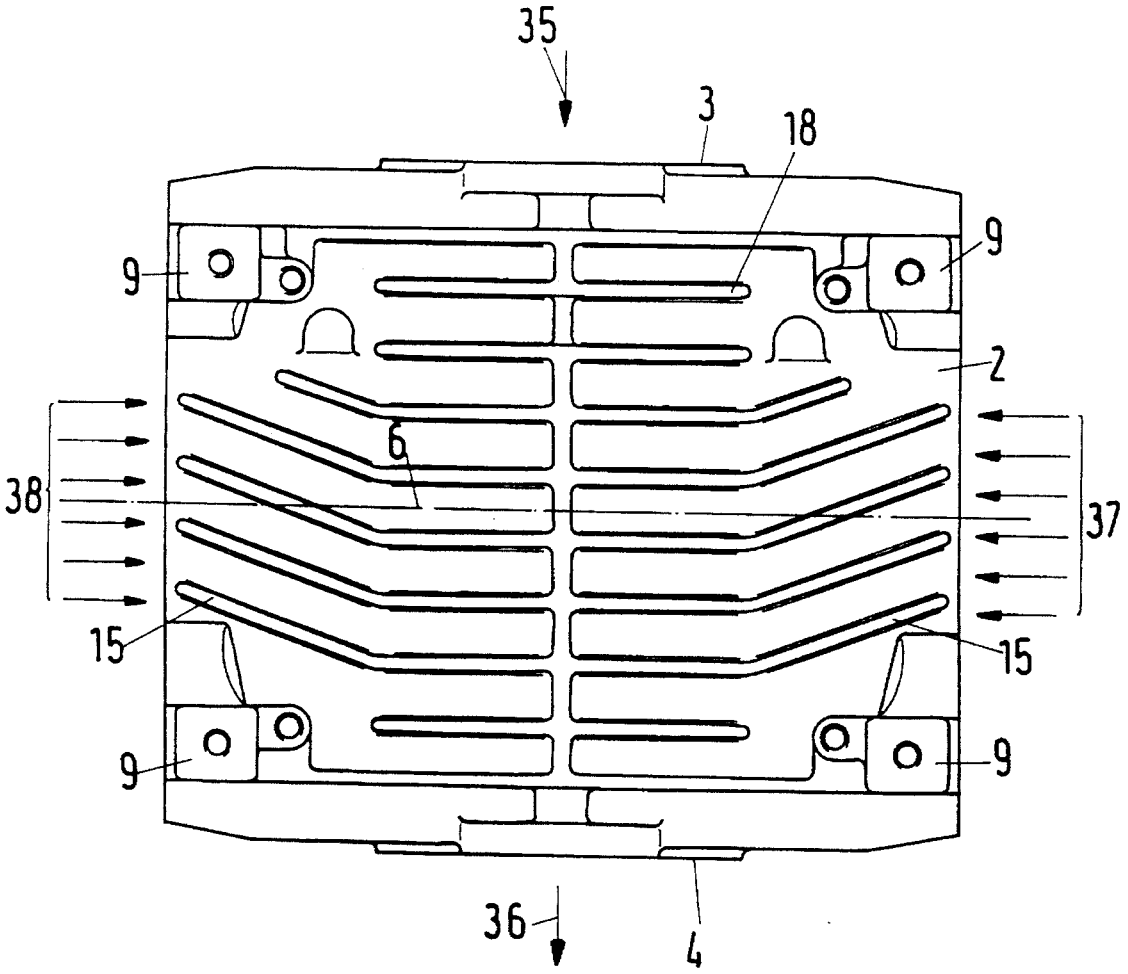
FIG. 4 is a view in Direction Y of FIG. 2.

FIG. 4 shows a view in the Direction Y of FIG. 2, whereby the underside of the housing 2 has the same type of ribbing. The bold arrows 35, 36 identify the path of the medium to be compressed from the suctioning side 3 to the pressure side 4. The smaller arrows 37, 38 are meant to symbolize the cooling air, which is introduced by the two fan propellers 24, 25 (see FIG. 3). In this drawing, the inclination of the fins in their end areas can clearly be seen. The inclination is slanted toward the suctioning side 3 and in this example has an angle of 20° degrees relative to the longitudinal axis 6. Preferably, the inclination should lie in an angle range between 10 and 30 degrees. If the angle is too flat, then the desired effect will be too slight; if the angle is too steep, then the longitudinal flow of the cooling air will be too greatly obstructed. The number of fins with an inclination is larger on the pressure side 4, so that a larger cooling air volume is pushed to the pressure side 4. As an amplifying effect, the fins 15 located on the pressure side 4 are higher, resulting in a greater cooling air cross-section, as can be clearly seen in FIG. 2.

The invention is not limited by the embodiments described above which are presented as examples only but can be modified in various ways within the scope of protection defined by the appended patent claims.

I claim:

1. An air-cooled vane-cell compressor, comprising: a housing having end faces, a bore hole that runs between the end faces, an outer surface, an upper side and a lower side, the housing further having a longitudinal axis and an axis transverse to the longitudinal axis; cooling air fins arranged on the outer surface of the housing in a longitudinal direction of the housing; a rotor having two free shaft ends and arranged within the housing, the rotor having a top dead center position and a bottom dead center position; covers arranged on the end faces of the housing, the rotor being rotatably supported in the covers; a suction flange and an ejection flange arranged in the housing at 90° to the covers and along a common longitudinal axis, the rotor having a rotational axis that is symmetrically arranged to the outer surface contour of the housing and to the flanges, the housing bore being doubly eccentric to the rotational axis of the rotor in the direction of top dead center position of the rotor, the fins vary over the outer surface of the housing so that taller fins are provided in an area of the bottom dead center and the ejection flange than fins in an area of the suction flange and top dead center; a first set of four feet, each one of the feet being arranged in a respective corner region of the upper side of the housing so as to be symmetric relative to the longitudinal and transverse axes of the housing; a second set of four feet, each one of the second set of feet being arranged in a respective corner region of the lower side of the housing so as to be symmetric relative to the longitudinal and transverse axes of the housing; a first fan propeller connected to a first one of the free shaft ends of the rotor; a second fan propeller connected to a second one at the free shaft ends of the rotor; a further cover arranged to partially cover the fins; and a cross-fin arranged on the housing at a midpoint of the longitudinal axis of the housing.

2. An air-cooled vane-cell compressor as defined in claim 1, wherein a number of the fins have end areas that are inclined relative to the longitudinal axis of the housing, whereby the fins are inclined toward the suction flange.

3. An air-cooled vane-cell compressor as defined in claim 2, wherein a greater number of fins are inclined on a pressure side of the housing than on a suction side of the housing.

4. An air-cooled vane-cell compressor as defined in claim 2, wherein the fins are inclined in a range of 10°–30°.

5. An air-cooled vane-cell compressor as defined in claim 4, wherein the fins are inclined 20°.

6. An air-cooled vane-cell compressor as defined in claim 1, and further comprising separating blades mounted on the rotor so as to be movable radially thereto.

* * * * *